US007066339B2

(12) United States Patent
Chiu et al.

(10) Patent No.: US 7,066,339 B2
(45) Date of Patent: Jun. 27, 2006

(54) ADJUSTABLE HANGING DEVICE

(75) Inventors: Light Chiu, Taichung Hsien (TW); Steve Huang, Taichung Hsien (TW)

(73) Assignee: Stanley Chiro International Ltd. (TW)

( * ) Notice: Subject to any disclaimer, the term of this patent is extended or adjusted under 35 U.S.C. 154(b) by 259 days.

(21) Appl. No.: 10/826,648

(22) Filed: Apr. 16, 2004

(65) Prior Publication Data

US 2005/0230335 A1 Oct. 20, 2005

(51) Int. Cl.
*A47F 7/00* (2006.01)

(52) U.S. Cl. ..... 211/70.6; 211/87.01; 211/113; 211/183

(58) Field of Classification Search ..... 211/70.6, 211/94.01, 113, 86.01, 87.01, 183; 206/372, 206/378; 248/123.2, 480, 497; 24/458; 33/451; 40/713

See application file for complete search history.

(56) References Cited

U.S. PATENT DOCUMENTS

| | | | | |
|---|---|---|---|---|
| 5,740,927 | A * | 4/1998 | Yemini | 211/70.6 |
| 5,967,340 | A * | 10/1999 | Kao | 211/70.6 |
| 6,386,363 | B1 * | 5/2002 | Huang | 206/378 |
| 6,415,933 | B1 * | 7/2002 | Kao | 211/70.6 |
| 6,758,350 | B1 * | 7/2004 | Lin | 211/70.6 |
| 6,854,607 | B1 * | 2/2005 | Tong | 211/70.6 |

* cited by examiner

*Primary Examiner*—Jennifer E. Novosad
(74) *Attorney, Agent, or Firm*—Ostrolenk, Faber, Gerb & Soffen, LLP

(57) ABSTRACT

An adjustable hanging device includes a longitudinal body and an adjustable socket member. The longitudinal body has a hanging portion, a mounting portion extending downwardly from the hanging portion, and a guiding hole extending in the hanging portion along a transverse direction of the longitudinal body. The guiding hole has two transversely opposite stop ends. The adjustable socket member is formed with a hanging hole, and is slidable in the guiding hole along the transverse direction between the transversely opposite stop ends so as to adjust position of the hanging hole relative to the center of gravity of the total mass of the adjustable hanging device and at least one object mounted on the adjustable hanging device.

9 Claims, 7 Drawing Sheets

ADJUSTABLE HANGING DEVICE

BACKGROUND OF THE INVENTION

1. Field of the Invention

The invention relates to a hanging device, more particularly to an adjustable hanging device adapted for mounting at least one object thereon.

2. Description of the Related Art

Referring to FIG. 1, a conventional hanging device 10 is shown to include a main shaft 11 and a hanging plate 12 connected laterally to the main shaft 11. The hanging plate 12 is provided with a receiving space 13 proximate to the main shaft 11 for mounting a plurality of sockets 100 therein. The hanging plate 12 further has a hanging portion 111 at an upper end thereof. The hanging portion 111 is formed with a hanging hole 112. A supporting member 200 extends through the hanging hole 112 so as to hang the hanging device 10 on the supporting member 200.

Although the aforesaid hanging device 10 is useful for hanging objects to be displayed (such as the sockets 100), it is difficult for the hanging device 10 to maintain its balance when the sockets 100 mounted thereon have different sizes.

Referring to FIG. 2, another conventional hanging device 20 is shown to include an upper hanging plate 21 and a lower mounting plate 22 connected to the upper hanging plate 21. The lower mounting plate 22 has a spanner 300 provided thereat. The upper hanging plate 21 has an anchoring member 23 proximate to and anchoring the spanner 300. The spanner 300 is provided with an adjustable mounting unit 301 at a lower end thereof for mounting an object (not shown) to be displayed thereon. The angle of the adjustable mounting unit 301 relative to the spanner 300 is adjustable to facilitate viewing of the displayed object.

Since a relatively large space is required to permit adjusting of the mounting unit 301, two hanging holes 24 are formed in an upper end of the hanging plate 21. Two supporting members 200 extend respectively through the hanging holes 24 so as to hang the hanging device 20 on the supporting members 200. Because two hanging holes 24 are required for the aforesaid hanging device 20, the hanging device 20 has a relatively large size, which in turn increases the production cost thereof.

SUMMARY OF THE INVENTION

The object of the present invention is to provide an adjustable hanging device adapted for mounting at least one object thereon. The hanging device can be adjusted to correspond to the center of gravity of the total mass of the adjustable hanging device and the object mounted thereon.

According to this invention, an adjustable hanging device includes a longitudinal body and an adjustable socket member.

The longitudinal body has a hanging portion, a mounting portion extending downwardly from the hanging portion, and a guiding hole extending in the hanging portion along a transverse direction of the longitudinal body. The guiding hole has two transversely opposite stop ends. The adjustable socket member is formed with a hanging hole, and is slidable in the guiding hole along the transverse direction between the transversely opposite stop ends so as to adjust position of the hanging hole relative to the center of gravity of the total mass of the adjustable hanging device and the object mounted thereon.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
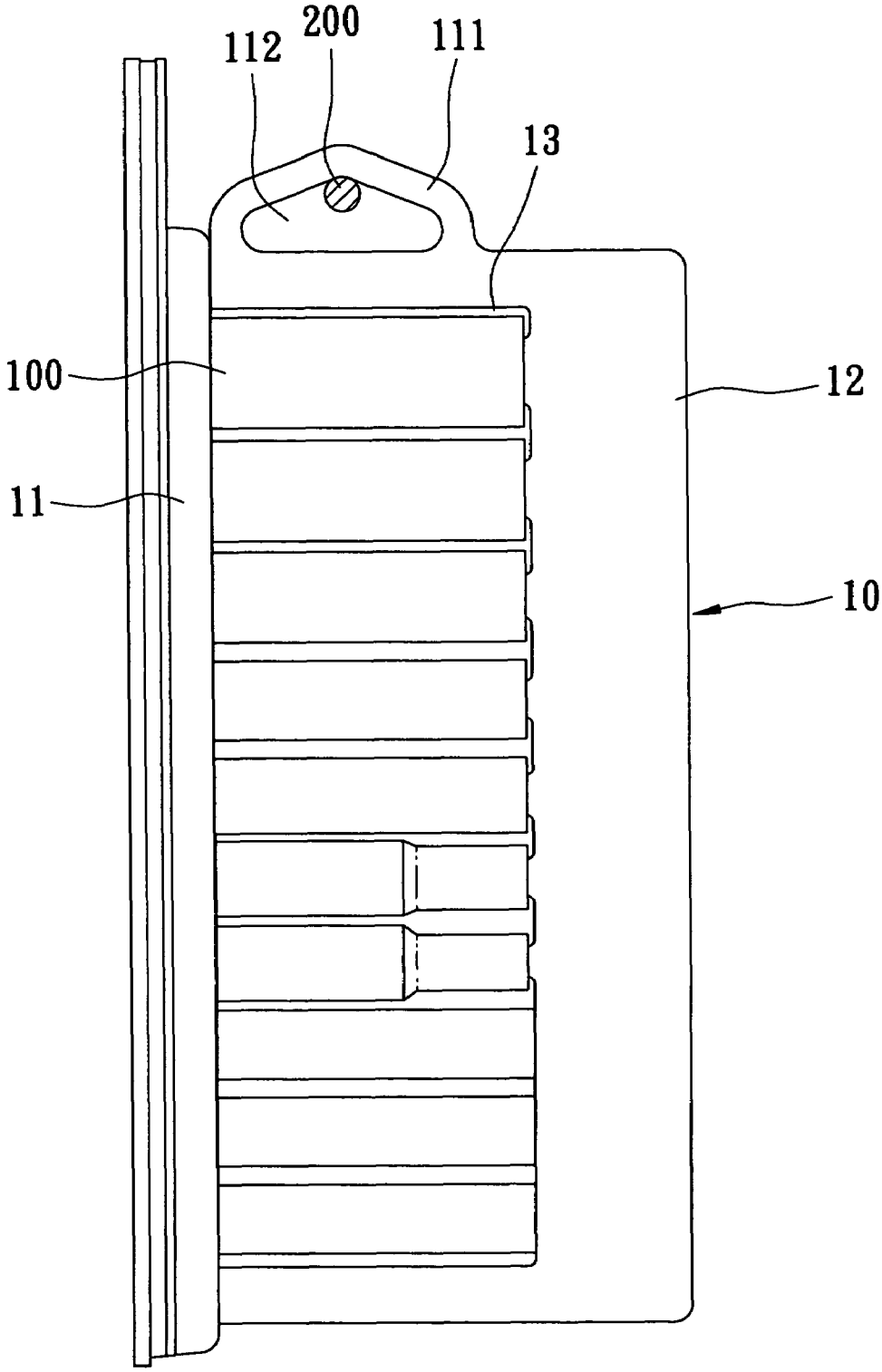
FIG. 1 PRIOR ART
FIG. 1 is a schematic view of a conventional hanging device.
Figure 2:
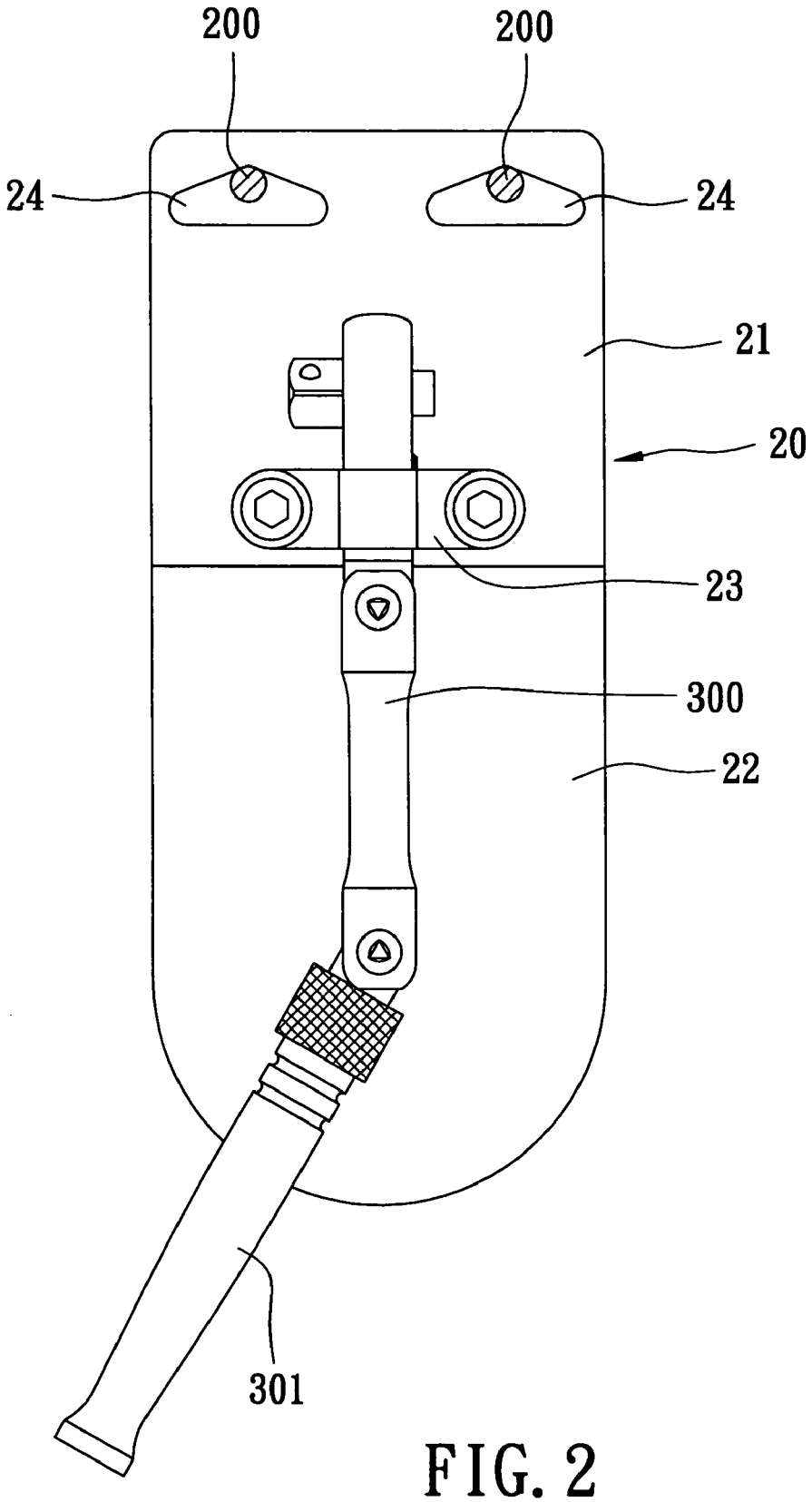
FIG. 2 PRIOR ART
FIG. 2 is a schematic view of another conventional hanging device.
Figure 3:
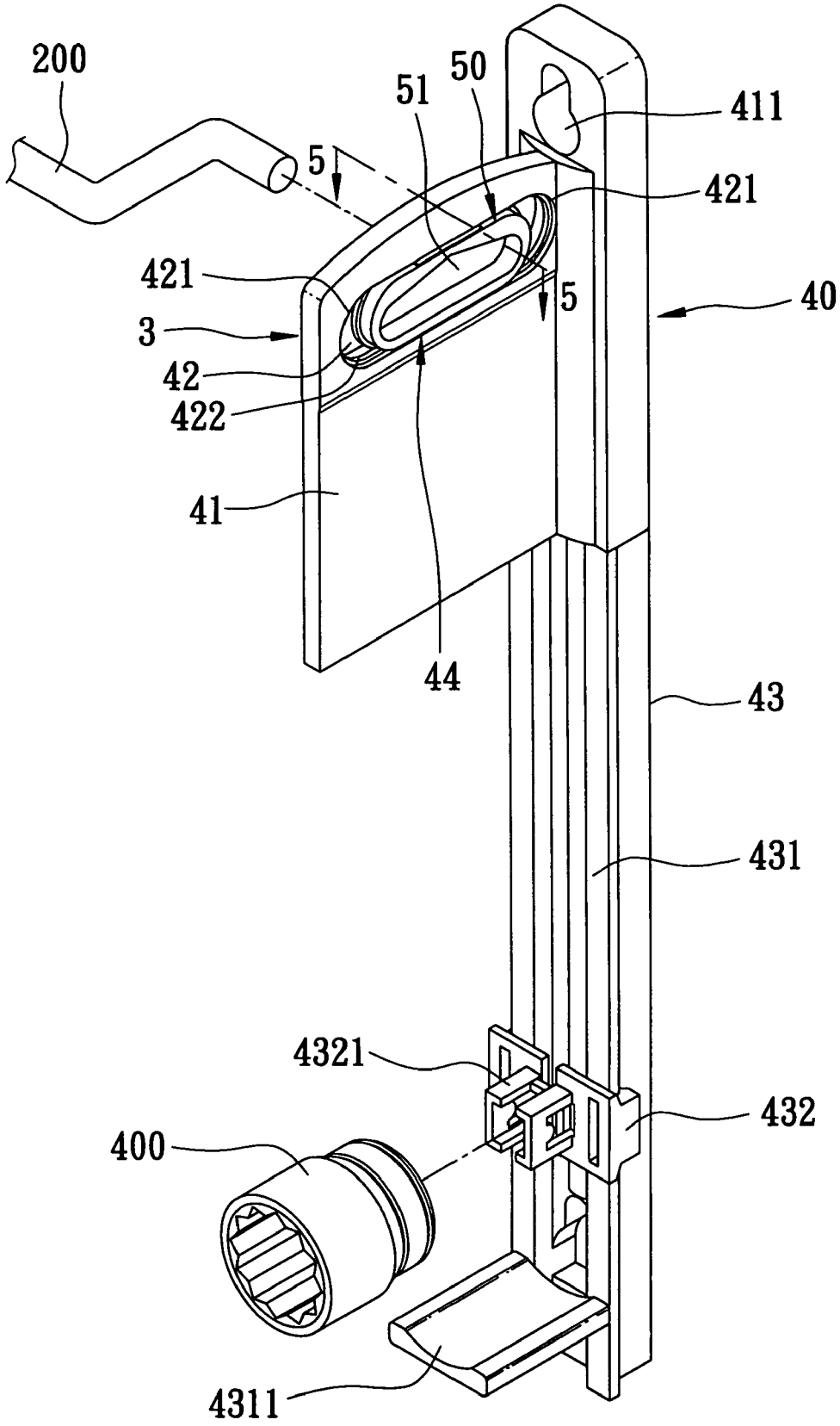
FIG. 3 is a perspective view of the preferred embodiment of the adjustable hanging device according to this invention.
Figure 4:
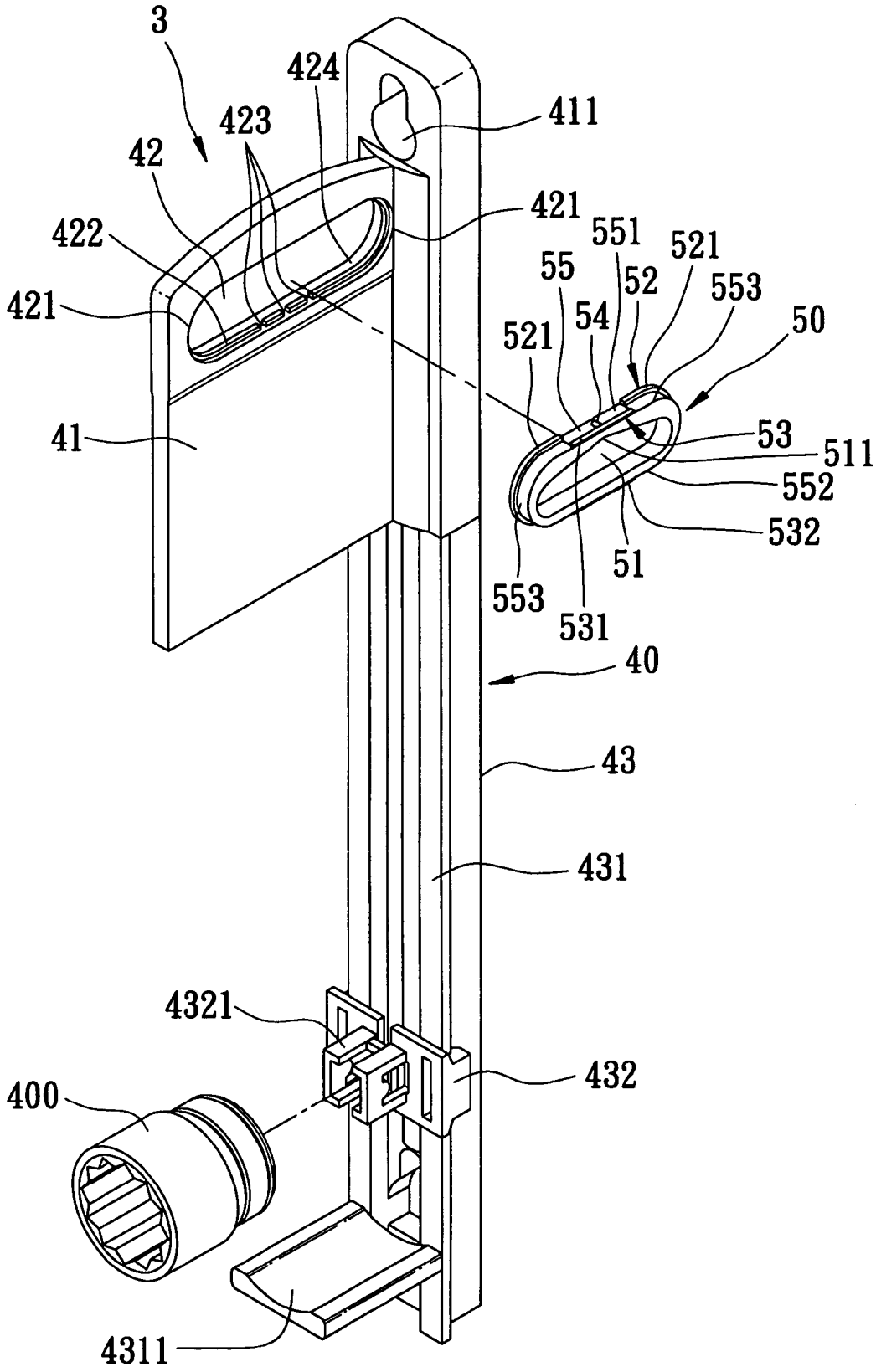
FIG. 4 is a partly exploded perspective view of the preferred embodiment.
Figure 5:
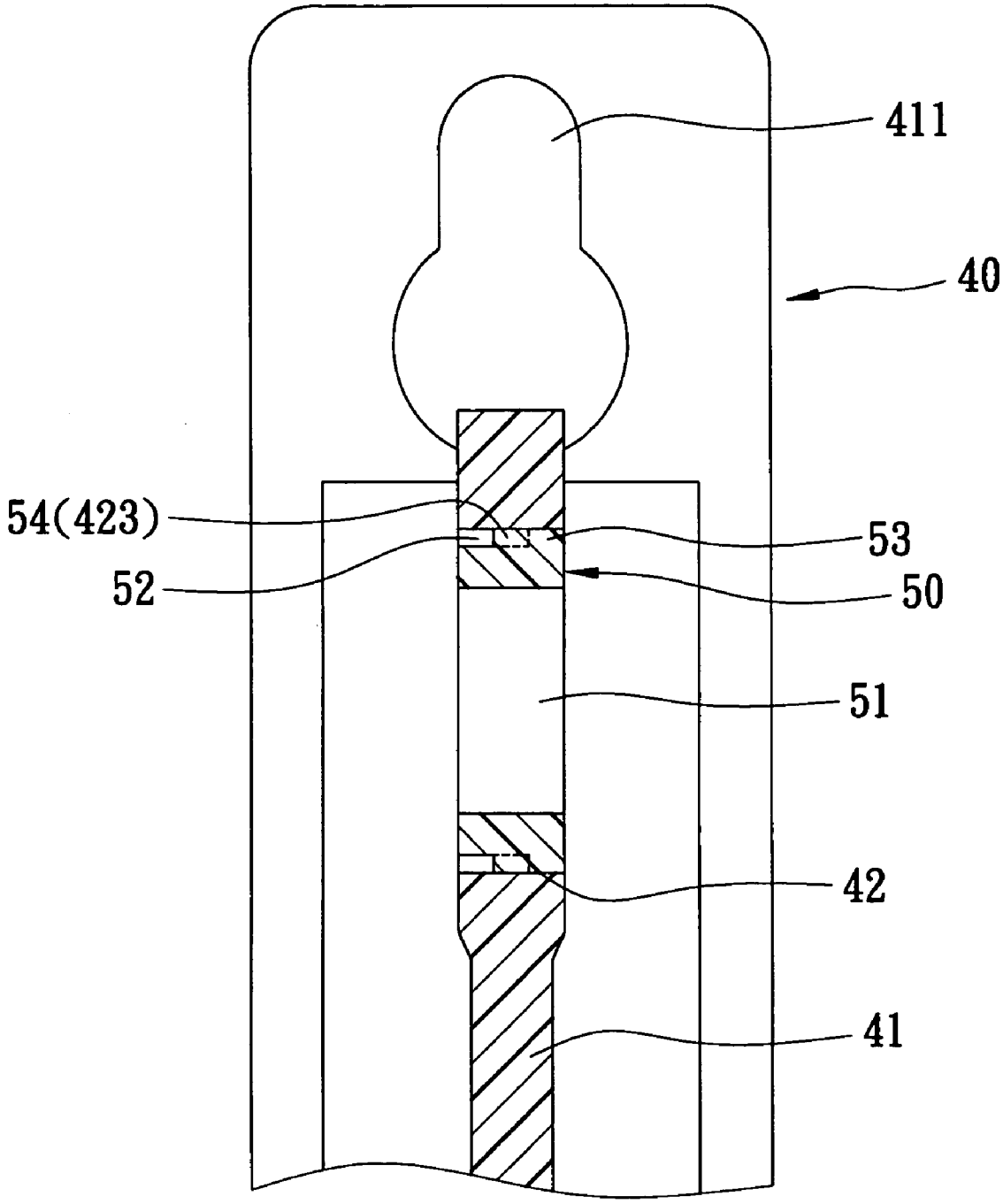
FIG. 5 is a fragmentary sectional view of the preferred embodiment taken along line 5—5 of FIG. 3.

Referring to FIGS. 3, 4, and 5, the preferred embodiment of the adjustable hanging device 3 according to this invention is shown to include a longitudinal body 40 and an adjustable socket member 50.

The longitudinal body 40 has a hanging portion 41 formed as a substantially rectangular plate, a mounting portion 43 extending downwardly from the hanging portion 41, and a guiding hole 42 extending in the hanging portion 41 along a transverse direction of the longitudinal body 40. The hanging portion 41 includes a boundary edge 424 which confines the guiding hole 42. The guiding hole 42 has two transversely opposite stop ends 421. The mounting portion 43 includes a guiding track 431 extending downwardly from the hanging portion 41, and at least a mounting seat 432 slidably installed on the guiding track 431 and having an engaging portion 4321 for engaging removably an object 400 (for example, a socket) to be displayed.

The adjustable socket member 50 is formed with a hanging hole 51 to permit extension of a supporting member 200 therethrough, and is slidable in the guiding hole 42 along the transverse direction between the transversely opposite stop ends 421 so as to adjust position of the hanging hole 51 relative to the center of gravity of the total mass of the adjustable hanging device 3 and the object 400 mounted thereon. Preferably, the hanging hole 51 a substantially triangular shape and is configured with a hanging apex 511. The adjustable socket member 50 further includes a peripheral edge face 55. The boundary edge 424 of the hanging portion 41 and the peripheral edge face 55 have interengaging elements 44 for slidably retaining the adjustable socket member 50 within the guiding hole 42.

Furthermore, the adjustable hanging device 3 includes an auxiliary hole 411 at an upper end of the longitudinal body 40 for securing the adjustable hanging device 3, and a stop plate 4311 at a lower end of the longitudinal body 40 to prevent falling of the object 400.

The interengaging elements 44 include a flange 422 projecting from and along the boundary edge 424 of the guiding hole 42, and first and second ribs 52, 53 projecting from and along the peripheral edge face 55 of the adjustable socket member 50. The flange 422 is made of a flexible material, and extends between the first and second ribs 52, 53. The peripheral edge face 55 includes a pair of linear upper and lower edge sections 551,552 and two arcuate side edge sections 553 interconnecting the linear upper and lower edge sections 551,552. The first rib 52 includes two curved rib sections 521 extending respectively along the arcuate side edge sections 553 of the peripheral edge face 55. The second rib 53 includes upper and lower rib sections 531,532 extending respectively along the linear upper and lower edge sections 551,552. The peripheral edge face 55 further includes positioning ribs 54 respectively formed on the linear upper and lower edge sections 551,552 transversely of the upper and lower rib sections 531,532. The flange 422 has gaps 423 provided at locations corresponding to the positioning ribs 54.

Figure 6:
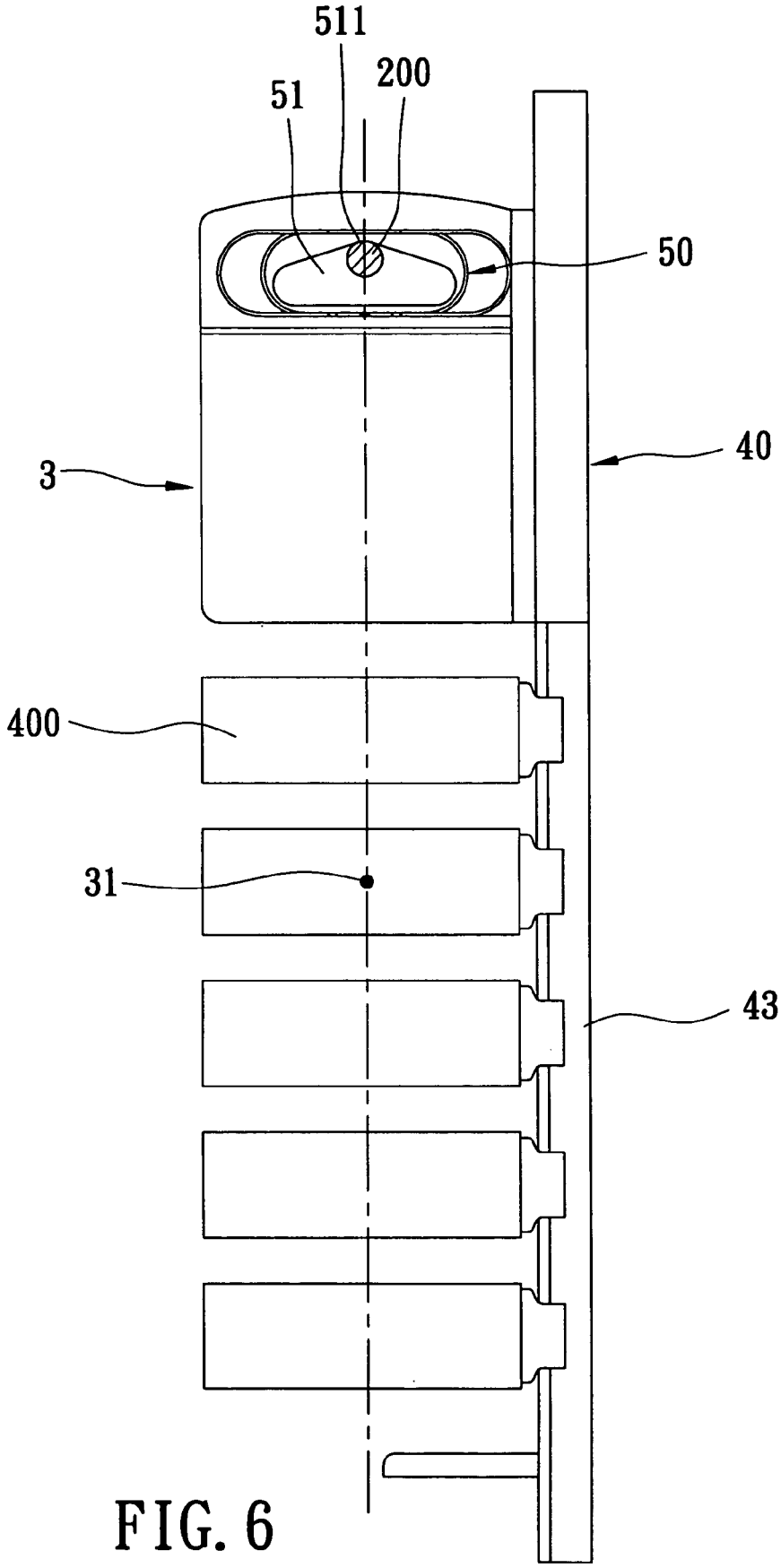
FIG. 6 is a schematic view of the preferred embodiment, in which a plurality of objects having identical sizes are mounted thereon.

Referring to FIG. 6, the mounting portion 43 of the longitudinal body 40 can be used for mounting a plurality of the objects 400 (such as sockets) thereon. When the mounted objects 400 are identical, the center of gravity 31 of the total mass of the adjustable hanging device 3 and the objects 400 thereon is substantially located at the middle of the adjustable hanging device 3. The position of the hanging hole 51 of the adjustable socket member 50 is located substantially in the middle of the adjustable hanging device 3 so as to align the hanging apex 511 with the aforesaid center of gravity 31 and so as to hang the adjustable hanging device 3 on the supporting member 200 at the hanging apex 511 in a balanced manner.

Figure 7:
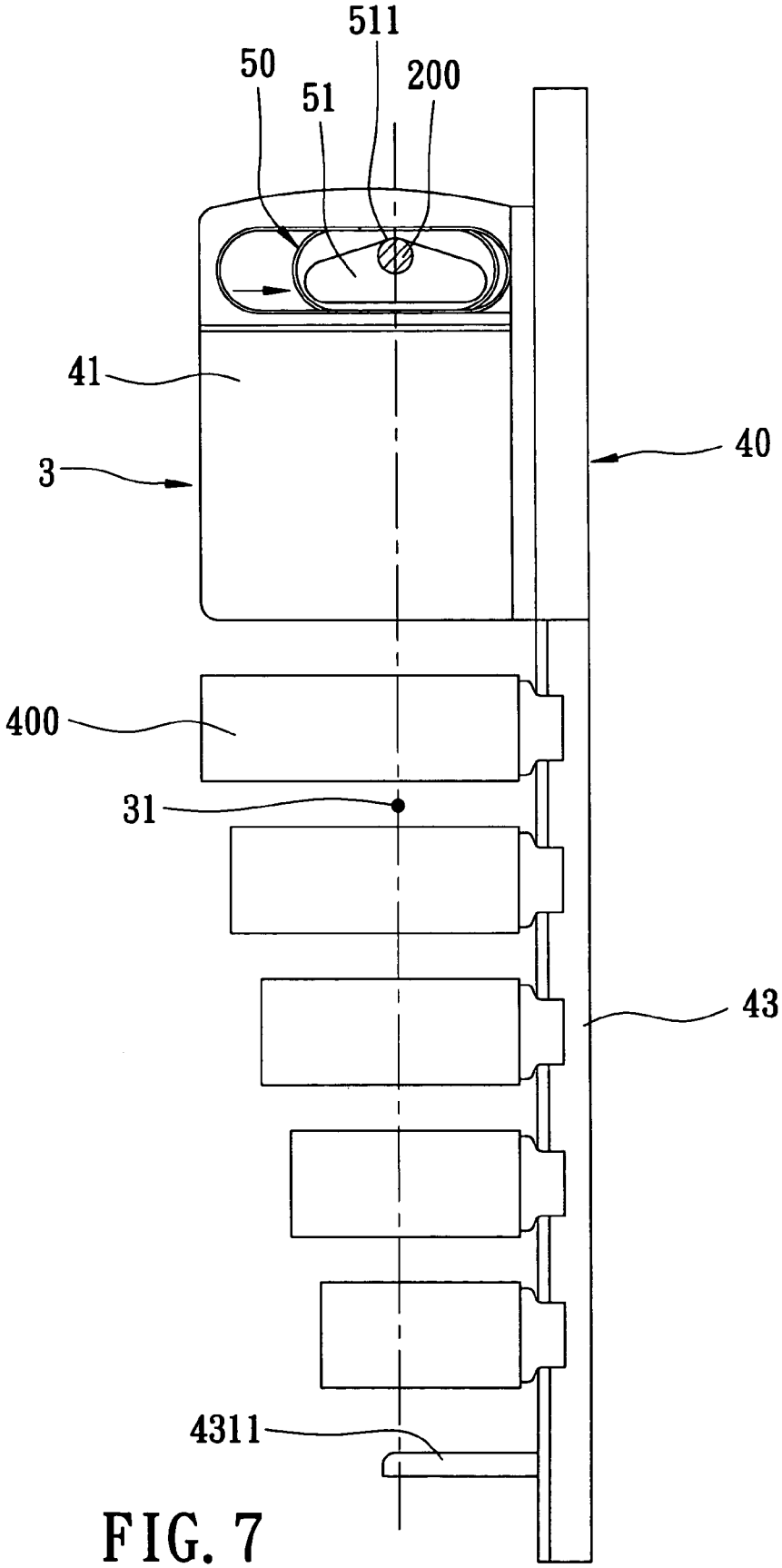
FIG. 7 is a schematic view of the preferred embodiment, in which a plurality of objects having different sizes are mounted thereon.

Referring to FIG. 7, when the mounted objects 400 are dissimilar and decrease gradually in weight along the direction from the hanging portion 41 toward the stop plate 4311, the center of gravity 31 of the total mass of the adjustable hanging device 3 and the objects 400 mounted thereon shifts rightwards. At this time, the position of the hanging hole 51 of the adjustable socket member 50 can be easily adjusted rightwards so as to align the hanging apex 511 with the aforesaid center of gravity 31 and so as to hang the adjustable hanging device 3 on the supporting member 200 at the hanging apex 511 in a balanced manner.

In view of the aforesaid, the position of the hanging hole 51 relative to the center of gravity 31 of the total mass of the adjustable hanging device 3 and the mounted objects 400 can be easily adjusted by moving the adjustable socket member 50. Therefore, the aforesaid shortcomings of the prior art can be overcome by the adjustable hanging device 3 of this invention.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

The invention claimed is:

1. An adjustable hanging device adapted for mounting at least one object thereon, comprising:

a longitudinal body including a hanging portion, a mounting portion extending downwardly from said hanging portion, and a guiding hole extending in said hanging portion along a transverse direction of said longitudinal body, said guiding hole having two transversely opposite stop ends; and an adjustable socket member formed with a hanging hole, and slidable in said guiding hole along said transverse direction between said transversely opposite stop ends so as to adjust position of said hanging hole relative to the center of gravity of total mass of said adjustable hanging device and the object mounted thereon.

2. The adjustable hanging device as claimed in claim 1, wherein said hanging portion includes a boundary edge which confines said guiding hole, said adjustable socket member further including a peripheral edge face, said boundary edge and said peripheral edge face having interengaging elements for slidably retaining said adjustable socket member within said guiding hole.

3. The adjustable hanging device as claimed in claim 2, wherein said interengaging elements include a flange projecting from and along said boundary edge of said guiding hole, and first and second ribs projecting from and along said peripheral edge face of said adjustable socket member, said flange extending between said first and second ribs.

4. The adjustable hanging device as claimed in claim 3, wherein said peripheral edge face includes a pair of linear upper and lower edge sections and two arcuate side edge sections interconnecting said linear upper and lower edge sections, said first rib including two curved rib sections extending respectively along said arcuate side edge sections of said peripheral edge face, said second rib including upper and lower rib sections extending respectively along said linear upper and lower edge sections.

5. The adjustable hanging device as claimed in claim 4, wherein said peripheral edge face further includes positioning ribs respectively formed on said linear upper and lower edge sections transversely of said upper and lower rib sections.

6. The adjustable hanging device as claimed in claim 5, wherein said flange has gaps provided at locations corresponding to said positioning ribs.

7. The adjustable hanging device as claimed in claim 3, wherein said flange is flexible.

8. The adjustable hanging device as claimed in claim 1, wherein said mounting portion includes a guiding track extending downwardly from said hanging portion, and at least a mounting seat slidably installed on said guiding track and having an engaging portion for removably engaging the object.

9. The adjustable hanging device as claimed in claim 1, wherein said hanging hole has a substantially triangular shape and is configured with a hanging apex.

* * * * *